US005704773A

United States Patent [19]

Higashiyama

[11] Patent Number: 5,704,773

[45] Date of Patent: Jan. 6, 1998

[54] OLDHAM COUPLING MECHANISM OF A SCROLL TYPE FLUID DISPLACEMENT APPARATUS

[75] Inventor: Akiyoshi Higashiyama, Isesaki, Japan

[73] Assignee: Sanden Corporation, Japan

[21] Appl. No.: 652,758

[22] Filed: May 23, 1996

[30] Foreign Application Priority Data

May 24, 1995 [JP] Japan ..... 7-151069

[51] Int. Cl.[6] ..... F01C 1/04; F16D 3/04

[52] U.S. Cl. ..... 418/55.3; 464/102

[58] Field of Search ..... 418/55.3; 464/102

[56] References Cited

U.S. PATENT DOCUMENTS

| | | | |
|---|---|---|---|
| 4,655,696 | 4/1987 | Utter | 418/55.3 |
| 4,992,033 | 2/1991 | Caillat et al. | 418/55.3 |
| 5,071,329 | 12/1991 | Sano et al. | 418/55.3 |
| 5,320,506 | 6/1994 | Fogt | 418/55.3 |
| 5,330,385 | 7/1994 | Hotta et al. . | |
| 5,403,172 | 4/1995 | Blass et al. | 418/55.3 |

FOREIGN PATENT DOCUMENTS

| | | | |
|---|---|---|---|
| 356716 | 3/1990 | European Pat. Off. . | |
| 516413 | 12/1992 | European Pat. Off. . | |
| 566475 | 10/1993 | European Pat. Off. . | |
| 62-181909 | 8/1987 | Japan . | |
| 63-88288 | 4/1988 | Japan | 418/55.3 |
| 63-138181 | 6/1988 | Japan | 418/55.3 |
| 3281996 | 12/1991 | Japan | 418/55.3 |
| 5149265 | 6/1993 | Japan | 418/55.3 |

*Primary Examiner*—John J. Vrablik
*Attorney, Agent, or Firm*—Baker & Botts, LLP

[57] ABSTRACT

A fluid displacement apparatus includes a housing having a fluid inlet and fluid outlet, and a pair of grooves disposed on an inner surface thereof. A fixed scroll is fixedly disposed within the housing and has a circular end plate from which a first spiral element extends into the interior of the housing. An orbiting scroll has a circular end plate from which a second spiral element extends and has a pair of grooves formed on the circular end plate. An Oldham coupling disposed between the orbiting scroll and the housing includes a ring, a pair of first engaging portions formed on the ring for engaging with the grooves on the end plate of the orbiting scroll and a pair of second engaging portions formed on the ring for engaging with the grooves disposed on the inner surface of the housing. The ring further comprises at least one ring portion subject to a compressive stress and at least one ring portion subject to a tensile stress. A cross sectional area of the at least one ring portion subject to compressive stress is smaller than a cross sectional area of the at least one ring portion subject to tensile stress. Accordingly, the fluid displacement apparatus has a light weight Oldham coupling which reduces noise and vibration during high speed operation.

15 Claims, 7 Drawing Sheets

OLDHAM COUPLING MECHANISM OF A SCROLL TYPE FLUID DISPLACEMENT APPARATUS

BACKGROUND OF THE INVENTION

1. Field of the Invention

The present invention relates to a scroll type fluid displacement apparatus. More particularly, the present invention relates to an Oldham coupling mechanism of a scroll type refrigerant compressor used in an automotive air conditioning system.

2. Description of the Prior Art

The Oldham coupling mechanism of a scroll type fluid displacement apparatus is well known in the art. For example, FIG. 1 depicts an Oldham coupling mechanism used in a scroll type refrigerant compressor as described in J.P. Pat. H-6-89750.

A scroll type fluid displacement apparatus comprises two scroll members each having a spiral element. The scroll members are maintained angularly and radially offset so that their spiral elements interfit to form a plurality of line contacts between their spiral curved surfaces and thereby seal off and define at least one pair of fluid pockets. In operation, the relative orbital motion of the two scroll members shifts the line contact along the spiral curved surfaces and therefore, the fluid pockets change in volume. Because the volume of the fluid pockets increases or decreases dependent on the direction of the orbital motion, this scroll type fluid displacement apparatus is applicable to compress, expand or pump fluid. One approach for preventing relative angular movement between the scrolls as they orbit with respect to one another resides in the use of an Oldham coupling operation between an orbiting scroll and a fixed portion of the apparatus.

Referring to FIGS. 1, 2, 3 and 4, rotation of orbiting scroll member 134 relative to housing 130 and fixed scroll member 136 is prevented by an Oldham coupling mechanism. Oldham coupling mechanism comprises Oldham ring 137 having ring portion 138 therein and a plurality of projections 139, 140, 141 and 142 radially extending from the outer peripheral of ring portion 138 and respectively formed to be angularly spaced 90 degrees from each other. A pair of projections 139 and 140 are diametrically opposed to each other and disposed in grooves 130*a* and 130*b* which are formed in housing 130. A pair of projections 141 and 142 are slidably disposed in grooves 134*a* and 134*b* which are formed in the axial end of orbiting scroll member 134.

When orbiting scroll member 134 orbits clockwise, for preventing rotation of orbiting scroll member 134, each of projections 141 and 142 is respectively subjected to a rotation force from orbiting scroll member 134 as indicated by an arrow shown in FIG. 3. On the other hand, and also for preventing rotation of orbiting scroll member 134, each of projections 139 and 140 is respectively subjected to a force caused by housing 130 as shown by an arrow in FIG. 3.

Thereby, a tensile force acts on ring portion 138*a* between projection 139 and 142, and acts on ring portion 138*c* between projections 140 and 141. On the other hand, a compression stress acts on ring portion 138*b* formed between projections 140 and 142, and acts on ring portion 138*d* between projections 139 and 141.

When Oldham coupling 137 prevents rotation of orbiting scroll member 134, orbiting scroll member 134 straightly slides along projections 141 and 142 in regard to Oldham coupling 137 so that grooves 134*a* and 134*b* slidably engage with projections 141 and 142 while projections 139 and 140 reciprocately slide in grooves 130*a* and 130*b* of housing 130. Thus, orbiting scroll member 134 orbits fixed scroll member 136 through these two movements.

The movement of orbiting scroll member 134 causes inertia force on Oldham coupling 137 resulting in vibration of Oldham coupling 137. The magnitude of vibration increases in proportion to the speed operation of the compressor and the weight of Oldham coupling 137. Consequently, to decrease the weight of Oldham coupling 137, for example, the thickness of ring portion 138 of Oldham coupling 137 is decreased to provide the compressor with reduced noise and vibration during its high speed operation.

Oldham coupling 137 is typically made of a material, such as sintering metal or aluminum die cast, having an ability to withstand compression stress greater than its ability to withstand tensile stress. Further, Oldham coupling 137 typically has a uniform thickness. Consequently, the cross sectional area of the entire ring is typically designed to sufficiently endure the tensile stress.

SUMMARY OF THE INVENTION

Accordingly, it is an object of the present invention to provide a fluid displacement apparatus which has light weight Oldham coupling for preventing rotation of orbiting scroll.

It is another object of the present invention to provide a fluid displacement apparatus with increased noise and vibration reduction during its high speed operation.

In order to obtain the above described objects, according to one embodiment of the present invention a scroll type fluid displacement apparatus comprises a housing having an inlet port and outlet port and a pair of grooves disposed on an inner surface of the housing. A fixed scroll is fixedly disposed within the housing and has a circular end plate from which a first spiral element extends into an interior of the housing. An orbiting scroll has a circular end plate from which a second spiral element extends and has a pair of grooves formed on the circular end plate. The first and second spiral elements interfit at an angular and radial offset to form a plurality of line contacts defining at least one pair of fluid pockets within the interior of the housing. A driving mechanism is operatively connected to the orbiting scroll to effect orbital motion of the orbiting scroll. An Oldham coupling is disposed between the orbiting scroll and the housing for preventing rotation of the orbiting scroll during orbital motion thereby enabling the orbital motion to change a volume of the at least one pair of fluid pockets. The Oldham coupling comprises a ring having at least one portion subject to a compressive stress and at least one portion subject to a tensile stress, a pair of first engaging means diametrically opposed to each other and a pair of second engaging means diametrically opposed to each other and angularly spaced from the pair of first engaging means by 90 degrees. The pair of first engaging means engages the pair of grooves of the circular end plate of the orbiting scroll. The pair of second engaging means engages the pair of grooves disposed on the inner surface of the housing. The at least one ring portion subject to a compressive stress has a cross sectional area smaller than a cross sectional area of the at least one ring portion subject to a tensile stress thereby reducing the weight of the Oldham ring and reducing noise and vibration during high speed operation of the fluid displacement apparatus.

A scroll type fluid displacement apparatus according to another embodiment comprises a housing having an inlet port and an outlet port and a pair of grooves disposed on an inner surface thereof. A fixed scroll is fixedly disposed within the housing and has a circular end plate from which a first spiral element extends into an interior of the housing. An orbiting scroll has a circular end plate from which a second spiral element extends and a pair of grooves formed on the circular end plate. The first and second spiral elements interfit at an angular and radial offset to form a plurality of line contacts defining at least one pair of fluid pockets within the interior of the housing. A driving mechanism is operatively connected to the orbiting scroll to effect orbital motion of the orbiting scroll. An Oldham coupling is disposed between the orbiting scroll and the housing for preventing rotation of the orbiting scroll during orbital motion and thereby enabling the orbital motion to change a volume of the at least one pair of fluid pockets. The Oldham coupling comprises a ring comprising four quarter circle portions and an intermediate straight wall portion, a pair of first engaging means formed on the ring and diametrically opposed to each other, and a second pair of engaging means formed on the ring and diametrically opposed to each other and angularly spaced from the first engaging means by 90 degrees. The pair of first engaging means engages the pair of grooves formed on the circular end plate of the orbiting scroll and the pair of second engaging means engages the pair of grooves disposed on the inner surface of the housing. The four quarter circle portions comprise a first pair of quarter circle portions symmetric to each other about a center point of the ring and a second pair of quarter circle portions symmetric to each other about the center of the ring. The cross sectional area of at least one of the first pair of quarter circle portions is smaller than the cross sectional area of at least one of the second pair of quarter circle portions thereby enabling the weight of the Oldham coupling to be reduced.

Other objects, features and advantages will be apparent to persons of ordinary skill in the art in view of the following detailed description of the invention and the accompanying drawings.

DETAILED DESCRIPTION OF THE PREFERRED EMBODIMENTS

Figure 1:
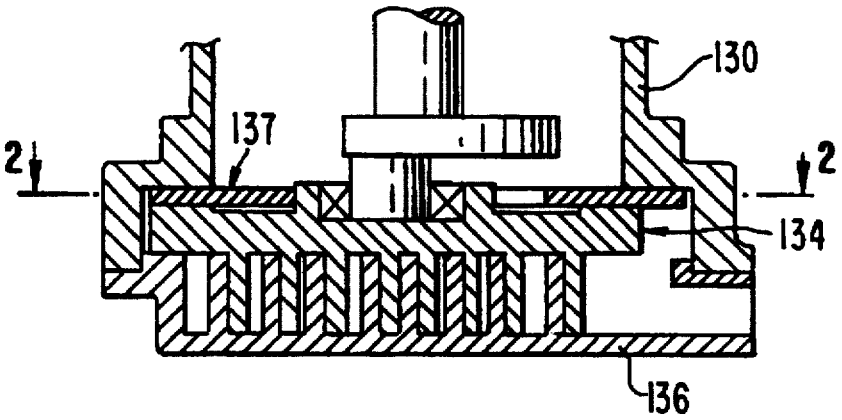
FIG. 1 PRIOR ART
FIG. 1 is a partial cross sectional view of a conventional scroll type refrigerant compressor.
Figure 2:
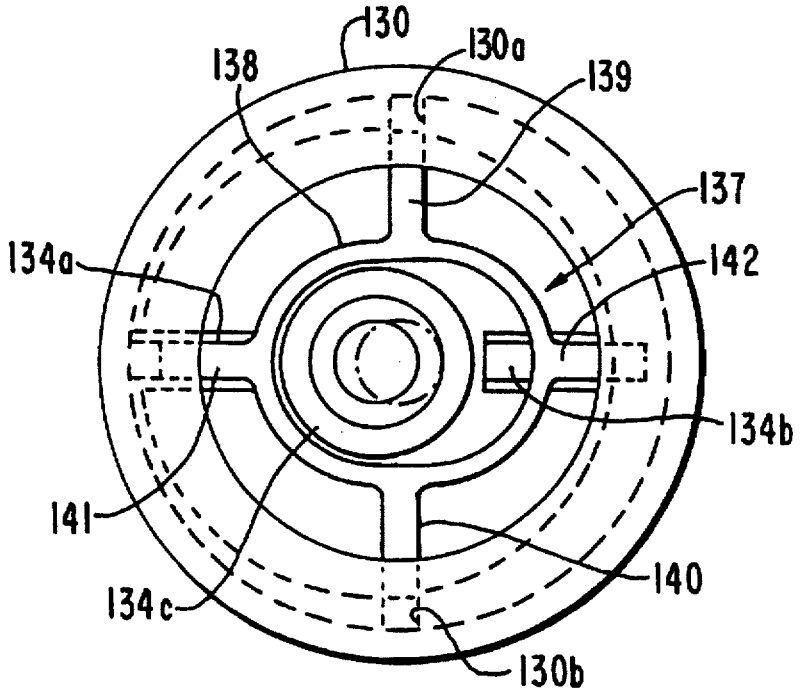
FIG. 2 PRIOR ART
FIG. 2 is a sectional view of an Oldham coupling mechanism taken along line 2—2 of FIG. 1.
Figure 3:
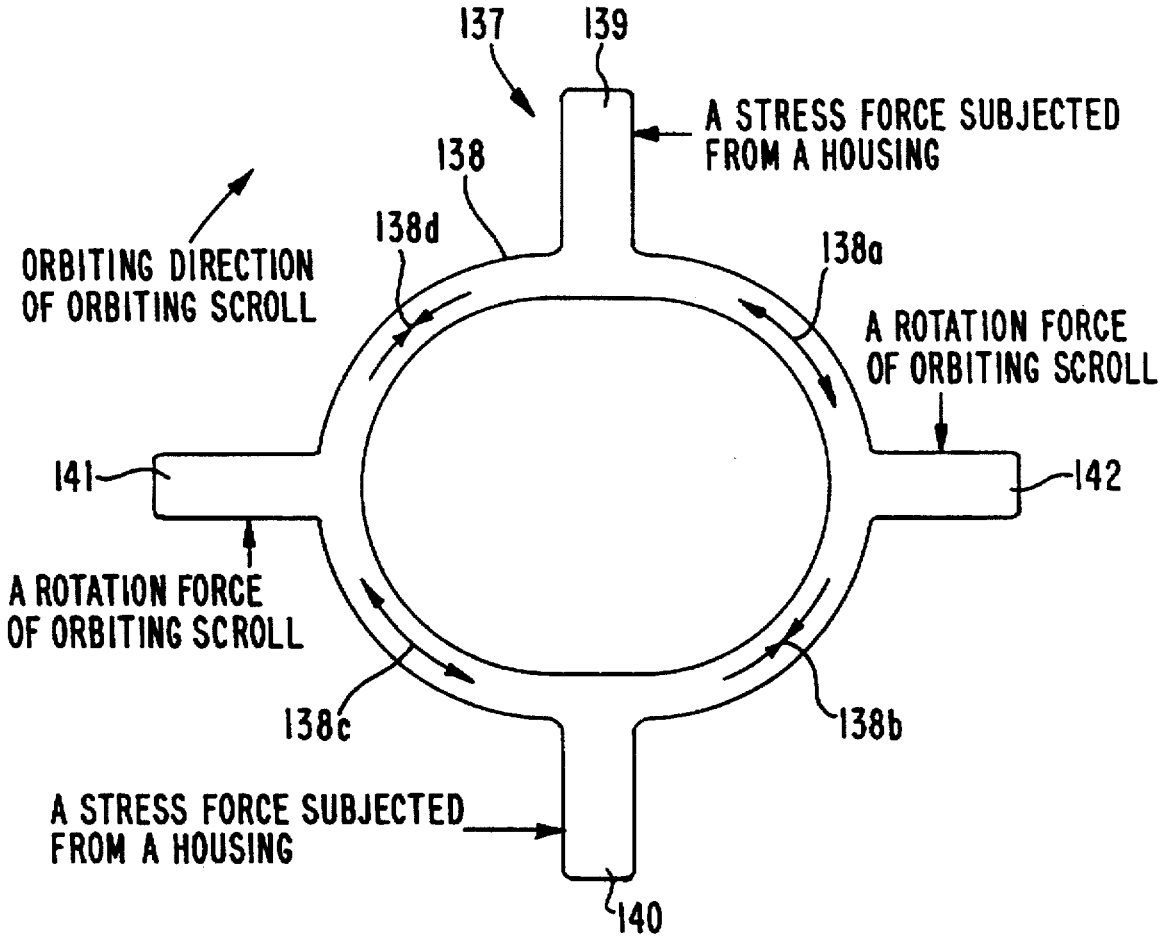
FIG. 3 PRIOR ART
FIG. 3 is a plane view of a conventional Oldham ring.
Figure 4:
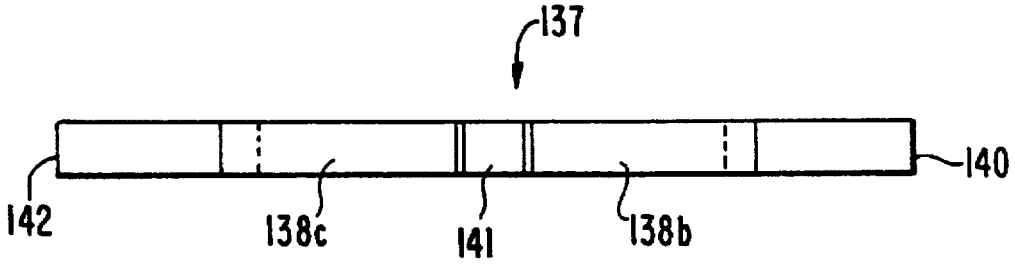
FIG. 4 PRIOR ART
FIG. 4 is a side elevational view of the Oldham ring of FIG. 3.
Figure 5:
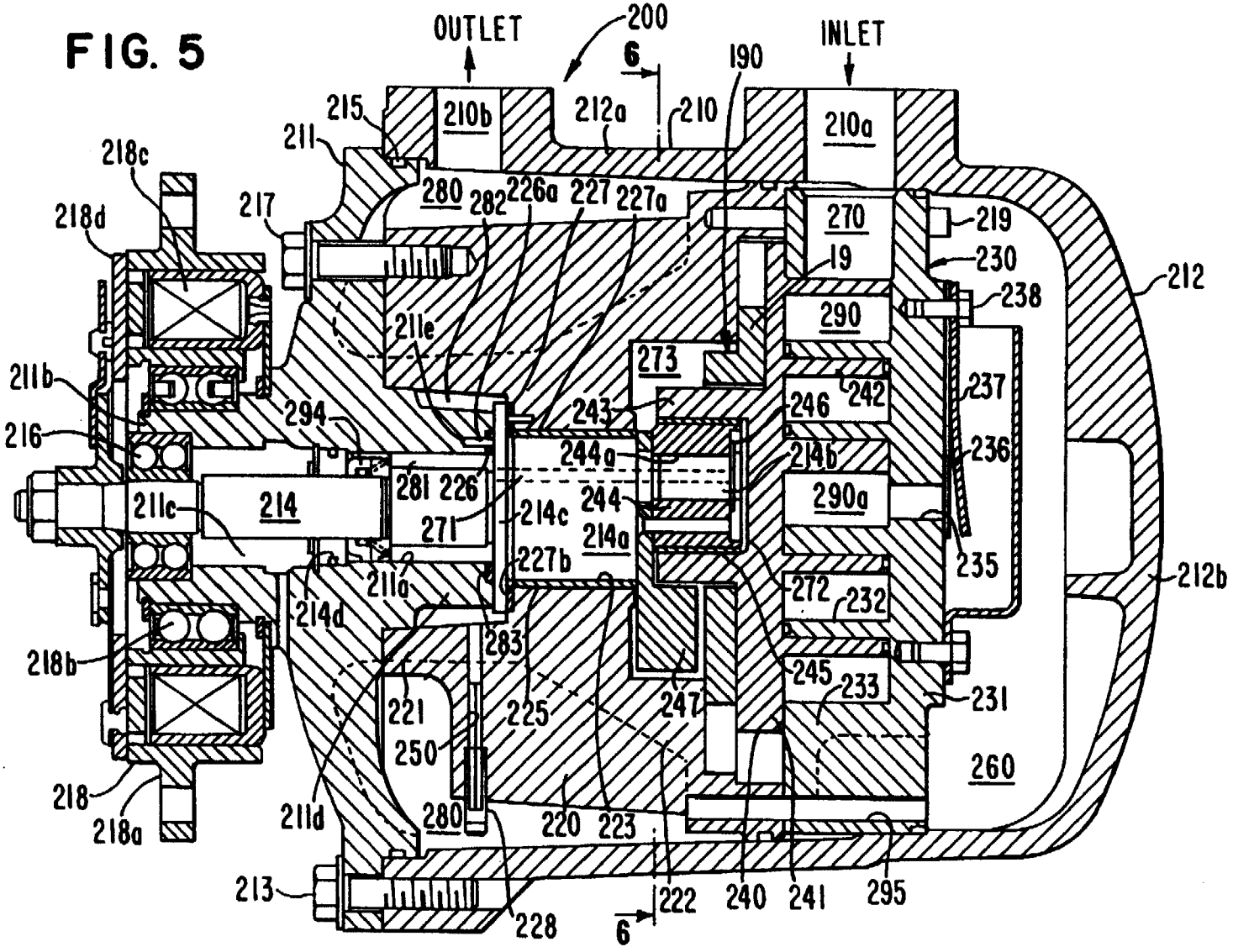
FIG. 5 is a longitudinal cross sectional view of a scroll type refrigerant compressor in accordance with a first embodiment of the present invention.

FIG. 5 shows a relevant part of a fluid displacement apparatus, such as a scroll type refrigerant compressor in accordance with a first embodiment of the present invention. Furthermore, in FIG. 5, for purposes of explanation only, the left side of the figure will be referenced as the forward end or front of the compressor, and the right side of the figure will be referenced as the rearward end or rear of the compressor.

With reference to FIG. 5, compressor 200 includes compressor housing 210 having front end plate 211 and cup-shaped casing 212 which is secured to front end plate 211 by a plurality of bolts 213. An opening 211*a* is formed in the center of front end plate 211 through which drive shaft 214, which is made of steel, passes. An end opening of cup-shaped casing 212 is covered by front end plate 211, and the mating surfaces between front end plate 211 and cup-shaped casing 212 are sealed by first O-ring 215. First annular sleeve 211*b* forwardly projects from a periphery of opening 211*a* to surround a front end portion of drive shaft 214 and define shaft seal cavity 211*c* therein. Shaft seal mechanism 294 is disposed within shaft seal cavity 211*c* and is mounted about drive shaft 214. Shaft seal mechanism 294 seals the interior of compressor housing 210 to prevent refrigerant and lubricating oil from escaping through opening 211*a*.

Drive shaft 214 is rotatably supported by first annular sleeve 211*b* through radial needle bearing 216. Second annular sleeve 211*d* rearwardly projects from the periphery of opening 211*a* so as to surround an inner end portion of drive shaft 214.

Inner block 220 has a front annular projection 221 and rear annular projection 222 and is disposed within an interior of housing 210. The interior of housing 210 is defined by the inner wall of cup-shaped casing 212 and the rear end surface of front end plate 211. Front annular projection 221 is fixedly attached to front end plate 211 by a plurality of bolts 217. Front annular projection 221 of inner block 220 surrounds second annular sleeve 211*d* of front end plate 211.

Drive shaft 214 has a cylindrical rotor 214*a* which is integral with and coaxially projects from an inner end surface of drive shaft 214. The diameter of cylindrical rotor 214*a* is greater than that of drive shaft 214. Cylindrical rotor 214*a* is rotatably supported by inner block 220 through radial plane bearing 225, which is fixedly disposed within opening 223 centrally formed through inner block 220. Radial plane beating 225 is fixedly disposed within opening 223 by, for example, forcible insertion. Pin member 214*b* is integral with, and projects from, a rear end surface of cylindrical rotor 214*a*. The axis of pin member 214*b* is radially offset from the axis of cylindrical rotor 214*a* and the axis of drive shaft 214 by a predetermined distance.

An electromagnetic clutch 218, which is disposed around first annular sleeve 211*b*, includes pulley 218*a* rotatably supported on sleeve 211*b* through ball bearing 218*b*, electromagnetic coil 218*c* disposed within an annular cavity of pulley 218*a*, and armature plate 218*d* fixed on an outer end of drive shaft 214, which extends from sleeve 211*b*. Drive shaft 214 is connected to and driven by an external power source through electromagnetic clutch 218.

The interior of housing 210 further accommodates fixed scroll 230, orbiting scroll 240, and a rotation preventing mechanism, such as an Oldham coupling mechanism 190, which prevents rotation of orbiting scroll 240 during operation of the compressor.

Fixed scroll 230 includes circular end plate 231, a first spiral element 232 affixed to or extending from a front side surface of circular end plate 231, and an outer peripheral wall 233 forwardly projecting from an outer periphery of circular plate 231. Orbiting scroll 240, which is located in suction chamber 270, includes circular end plate 241 and a second spiral element 242 affixed to or extending from a rear side surface of end plate 241. Second spiral element 242 of orbiting scroll 240 and first spiral element 232 of fixed scroll 230 interfit at an angular offset of 180 degrees and a predetermined radial offset to make a plurality of line contacts. Therefore, at least one pair of sealed off fluid pockets 290 are defined between spiral elements 232 and 242.

Additionally, orbiting scroll 240 further includes an annular boss 243, which forwardly projects from a central region of a front end surface of circular end plate 241. Bushing 244 is rotatably disposed within boss 243 through radial plane bearing 245. Radial plane bearing 245 is fixedly disposed within boss 243 by, for example, forcible insertion. Bushing 244 has a hole 244*a* axially formed therethrough. The axis of hole 244*a* is radially offset from the axis of bushing 244. As described above, pin member 214*b* is radially offset from the axis of cylindrical rotor 214*a* (and the axis of drive shaft 214) by a predetermined distance.

Pin member 214*b* is rotatably disposed within hole 244*a* of bushing 244. Pin member 214*b* projects from the rear end surface of bushing 244, and snap ring 246 is fixedly secured to the terminal end portion of pin member 214*b* to prevent an axial movement of pin member 214*b* within hole 244*a*. Drive shaft 214, pin member 214*b* and bushing 244 form a driving mechanism for orbiting scroll 240. Counterbalance weight 247 is disposed within suction chamber 270 and is connected to a front end of bushing 244. Annular flange 214*c* is made of steel, for example, and is positioned at the boundary of the inner end portion of drive shaft 214 and cylindrical rotor 214*a*.

First thrust plane bearing 226 is fixedly disposed within an annular cut-out portion 211*e*, which is formed at an outer peripheral region of the rear end surface of second annular sleeve 211*d*, by a plurality of fixing pins 226*a*. Second thrust plane bearing 227, which is substantially identical to first thrust plane bearing 226, is fixedly disposed within a shallow annular depression 227*b*, which is formed at the front end surface of inner block 220 along a periphery of opening 223, by a plurality of fixing pins 227*a*.

Fluid passage 271 is axially formed through pin member 214*b* and cylindrical rotor 214*a*. One end of fluid passage 271 is open to an axial air gap 272 created between the rear end surface of bushing 244 and the front end surface of circular end plate 241 of orbiting scroll 240. The other end of fluid passage 271 is open to a radial air gap 281 created between an inner peripheral surface of second annular sleeve 211*d* and an outer peripheral surface of the inner end portion of drive shaft 214. Radial air gap 281 is linked to a hollow space 282, which is defined by second annular sleeve 211*d* of front end plate 211 and front annular projection 221 of inner block 220, through either an axial air gap 283 created between annular flange 214*c* and first thrust plane bearing 226. Hollow space 282 is linked to a lower portion of second discharge chamber 280 through conduit 228 which is radially formed through inner block 220.

A discharge port 235 is formed through circular end plate 231 of fixed scroll 230 at a position near the center of spiral element 232. Reed valve member 236 cooperates with discharge port 235 to control the opening and closing of discharge port 235 in response to a pressure difference between first discharge chamber 260 and central fluid pocket 290*a*. Retainer 237 prevents excessive bending of reed valve member 236 when discharge port 235 is opened. An end of reed valve member 236 and the end of retainer 237 are fixedly secured to circular end plate 231 by single bolt 238. Outer peripheral wall 233 of fixed scroll 230 is fixedly attached to rear annular projection 222 of inner block 220 by a plurality of screws 219.

First discharge chamber 260 is defined by circular end plate 231 of fixed scroll 230 and a rear portion 212*b* of cup-shaped casing 212. Suction chamber 270 is defined by circular end plate 231 of fixed scroll 230, cylindrical portion 212*a* of cup-shaped casing 212 and inner block 220. Second discharge chamber 280 is defined by inner block 220, cylindrical portion 212*a* of cup-shaped casing 212 and front end plate 211.

Inlet port 210*a* is formed on cylindrical portion 212*a* of cup-shaped casing 212 at a position corresponding to suction chamber 270. Outlet port 210*b* is formed on cylindrical portion 212*a* of cup-shaped casing 212 at a position corresponding to second discharge chamber 280.

A plurality of fluid passages 295 are axially formed through outer peripheral wall 233 of fixed scroll 230 and rear annular projection 222 of inner block 220 along the periphery thereof so as to link first discharge chamber 260 to second discharge chamber 280.

During operation, Oldham coupling mechanism 190 functions as the rotation preventing device for orbiting scroll 240, and is disposed between circular end plate 241 of orbiting scroll 240 and rear annular projection 222 of inner block 220. As orbiting scroll 240 orbits, the line contacts between spiral elements 232 and 242 cause fluid pockets 290 to move toward the center with a consequent reduction in volume and compression of the fluid in fluid pockets 290. Refrigerant gas, which is introduced from a component such as an evaporator (not shown) of a refrigerant circuit (not shown), through fluid inlet port 210*a*, is taken into the fluid pockets 290 formed from the outer end portion of the spiral elements.

The refrigerant gas taken into the fluid pockets 290 is then compressed and discharged through discharge port 235 into first discharge chamber 260 from the central fluid pocket 290*a* of spiral elements 232 and 242. Thereafter, the refrigerant gas in first discharge chamber 260 flows to second discharge chamber 280 through fluid passages 295. The refrigerant gas flowing into second discharge chamber 280 further flows through outlet port 210*b* to another component, such as a condenser (not shown) of the refrigerant circuit (not shown). Further, a lubricating oil accumulated at a bottom portion of the interior of first discharge chamber 260 flows into the bottom portion of the interior of second discharge chamber 280 through fluid passages 295, which are axially formed through outer peripheral wall 233 of fixed scroll 230 and rear annular projection 222 of inner block 220. The lubricating oil in the bottom portion of the interior of second discharge chamber 280 is conducted into a hollow space 273 of suction chamber 270 created between inner block 220 and circular end plate 241 of orbiting scroll 240 by virtue of the pressure differential between second discharge chamber 280 and suction chamber 270 via conduit 228, hollow space 282, axial air gap 283 of first thrust plane bearing 226, fluid passage 271, axial air gap 272, and the radial air gaps created between boss 243 and radial plane bearing 245 and between bushing 244 and radial plane bearing 245. The lubricating oil conducted into hollow space 273 flows into suction chamber 270 at a position which is outside spiral elements 232 and 242, and past Oldham coupling mechanism 190 to lubricate the mechanism.

Figure 6:
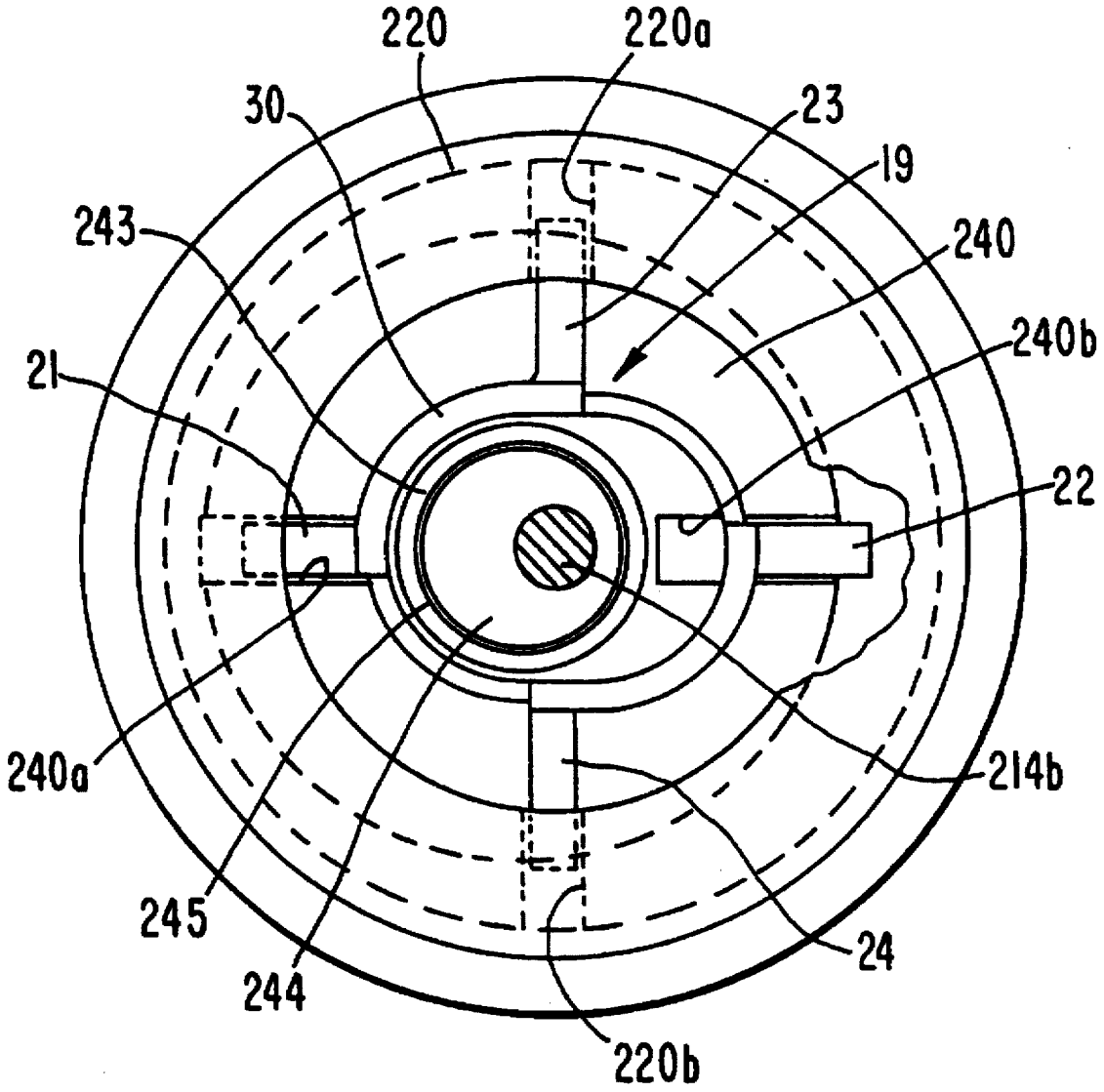
FIG. 6 is a sectional view of an Oldham coupling mechanism taken along line 6—6 of FIG. 5.
Figure 7:
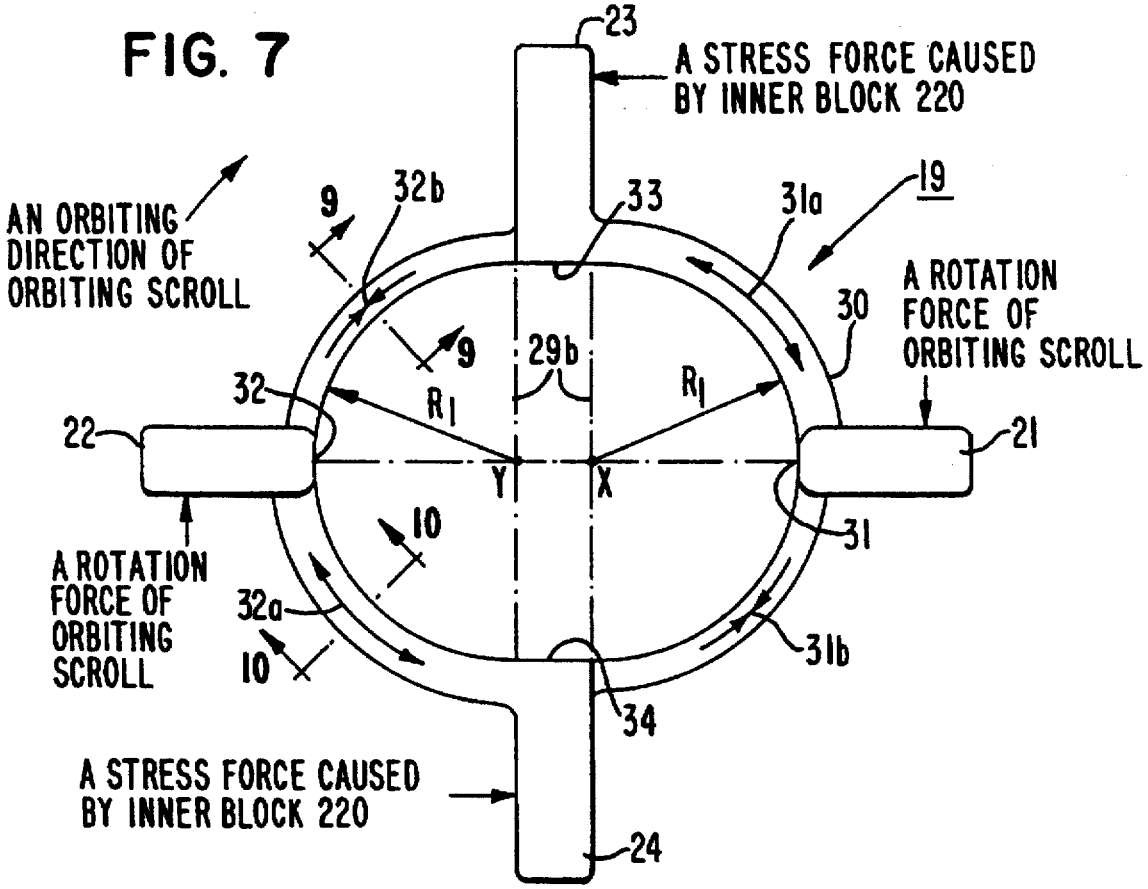
FIG. 7 is a plane view of an Oldham ring in accordance with the first embodiment of the present invention.
Figure 8:
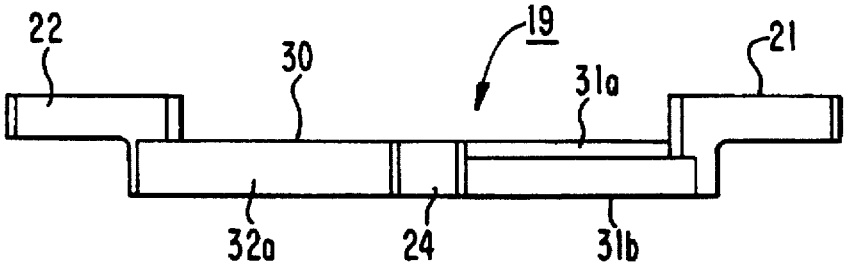
FIG. 8 is a side elevational view of the Oldham ring of FIG. 7.

Referring to FIGS. 6, 7 and 8, rotation of orbiting scroll member 240 relative to inner block 220 and fixed scroll member 230 is prevented by an Oldham coupling mechanism 190. Oldham coupling mechanism 190 comprises Oldham ring 19 having ring portion 30 thereof and a plurality of projections 21, 22, 23 and 24 extending from the outer peripheral of ring portion 30. A pair of projections 21 and 22 are axially offset from the one end surface of ring portion 30 and are further diametrically opposed to each other. A pair of projections 23 and 24 are diametrically opposed to each other and angularly spaced from projections 21 and 22 by 90 degrees.

Projections 21 and 22 are slidably disposed in grooves 240*a* and 240*b* which are formed in the axial end of orbiting scroll 240. A pair of projections 23 and 24 are slidably disposed in grooves 220*a* and 220*b* which are formed in the rear end of inner block 220 so as to be diametrically opposed to each other.

Oldham ring 19 has a unique configuration such as a general oval or "racetrack" shape, having a minimum inside dimension sufficient to clear the peripheral edge of boss 243 of orbiting scroll member 240. The inside peripheral wall of Oldham ring portion 30 comprises a first half ring 31 of a radius R1 taken from center X and a second half ring 32 of the same radius R1 taken from center Y, with the intermediate wall portions being substantially straight, as at 33 and 34. Center portions X and Y are spaced apart a distance equal to twice the orbital radius of orbiting scroll member 240 and are located on radial lines 296 passing through the ends of projections 25 and 24. Radius R1 is equal to the radius of boss 243 plus a predetermined minimum clearance.

When orbiting scroll member 240 orbits clockwise (as shown by an arrow FIG. 7), for preventing rotation of orbiting scroll member 240, each of projections 21 and 22 is respectively subjected to a rotation force from orbiting scroll member 240 as shown in FIG. 7. On the other hand, and also for preventing rotation of orbiting scroll member 240, each of projections 23 and 24 is respectively subjected to a stress force caused by inner block 220 as shown in FIG. 7.

Thereby, a tensile force occurs and acts on ring portion 31*a* formed between projections 21 and 23, and ring portion 32*a* formed between projections 22 and 24. On the other hand, a compression stress occurs and acts on ring portion 31*b* formed between projections 21 and 24, and ring portion 32*b* formed between projections 22 and 25.

Figure 9:
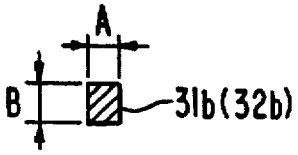
FIG. 9 is a cross sectional view of an Oldham ring taken along line 9—9 of FIG. 7.
Figure 10:
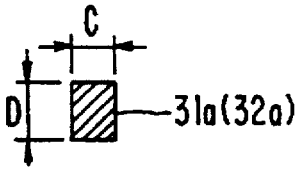
FIG. 10 is a cross sectional view of an Oldham ring taken along line 10—10 of FIG. 7.

Ring portions 31*b* and 32*b* include respectively a uniform cross sectional area thereof. The cross sectional area of at least one of ring portions 31*b* and 32*b* is preferably smaller than the cross sectional area of ring portions 31*a* and 32*a* which also have a uniform cross sectional area. As shown in FIG. 9, the cross sectional area of ring portions 31*b* and 32*b* is determined by multiplying width A by thickness B. Cross sectional area of 31*a* and 32*a* is determined by multiplying width C by thickness D. The cross sectional area relationship between ring portions 31*a*/32*a* and 31*b*/32*b* according to this first embodiment of the present invention satisfies the following inequality.

$$A \times B < D \times C$$

That is, either or both of the width A and the thickness B of said cross sectional area of ring 31*b* (32*b*) is preferably smaller than either or both of the width C and the thickness D of cross sectional area of ring portion 31*a* (32*a*).

In operation, Oldham ring 19 prevents rotation of orbiting scroll member 240 as follows. Orbiting scroll member 240 straightly slides along projection 21 and 22 of Oldham ring 19 so that grooves 240*a* and 240*b* slidably engage with projections 21 and 22. Further, projections 23 and 24 reciprocately slide in grooves 220*a* and 220*b* of inner block 220. Thus, orbiting scroll member 240 orbits fixed scroll member 230 through these two movements without rotation.

Oldham coupling 190 is made of a material, such as sintering metal or aluminum die cast, having an ability to withstand compression stress greater than an ability to withstand tensile stress. Therefore, the weight of Oldham coupling 190 is reduced. Further, the structure of Oldham ring 19 according to the first embodiment of the present invention enables a further substantial weight decrease without a reduction in durability. That is, ring portions 31*a* and 32*a* have a cross sectional area sufficient to endure the tensile stress which they are subjected to. Ring portions 31*b* and 32*b*, on the other hand, which are subjected to compression stress, have a smaller cross sectional area than ring portions 31*a* and 32*a* thereby enabling the weight of Oldham ring 19 to be further decreased.

The decreased weight of Oldham ring 19, decreases the inertia force on Oldham ring 19 caused by the rotation movement of orbiting scroll member 240. As a result, the magnitude of vibration caused by the inertia force on Oldham ring 19 decreases. The improvement provides the compressor with reduced noise and vibration during high speed operation.

A second embodiment of the present invention applicable to a compressor having a different arrangement from the compressor of the first embodiment will be explained in conjunction with FIGS. 11–15.

Figure 11:
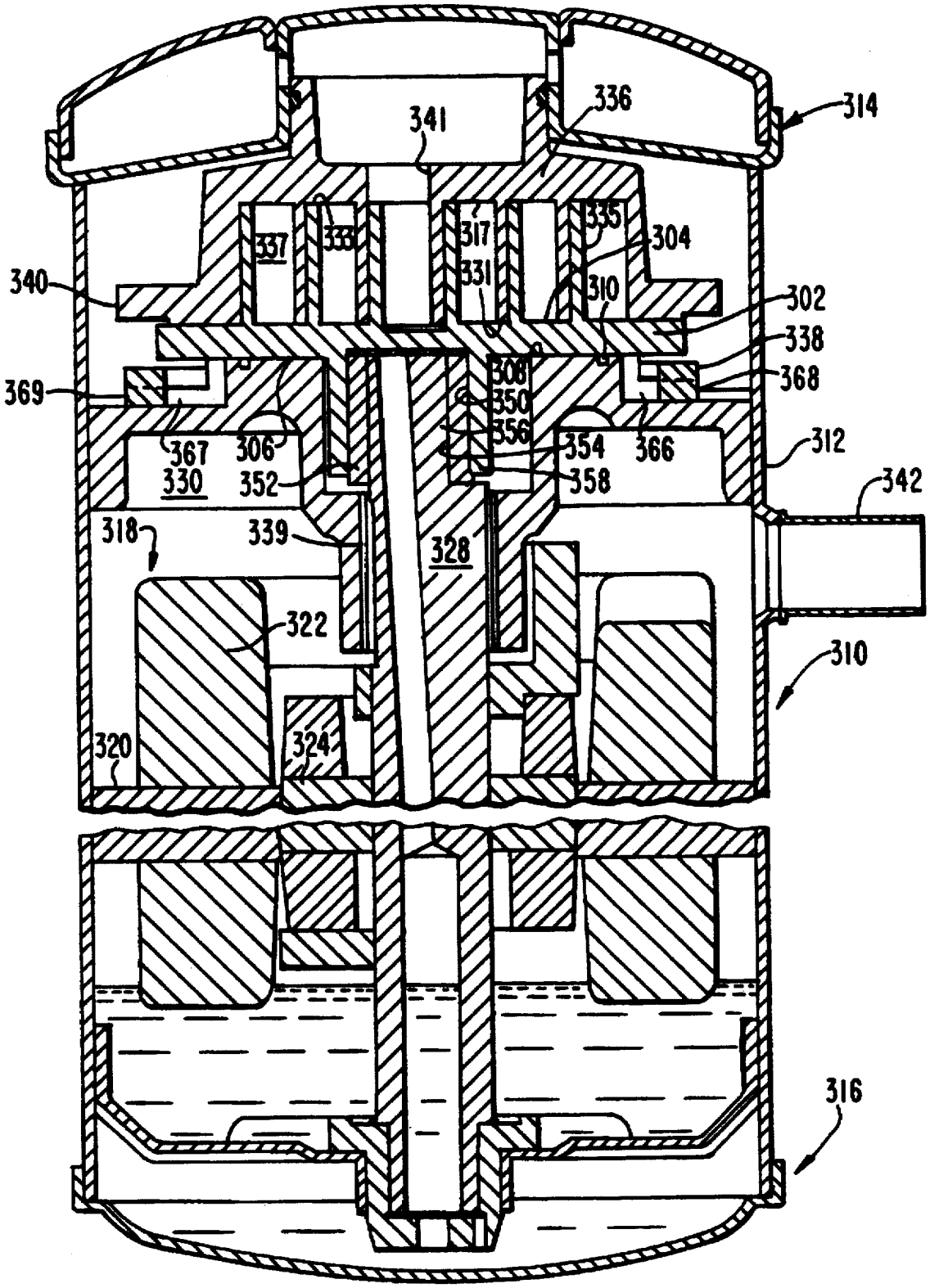
FIG. 11 is a longitudinal cross sectional view of a scroll type refrigerant compressor in accordance with a second embodiment of the present invention.

Referring to FIG. 11, the compressor comprises three overall units, i.e., a central assembly 310 housed within a circular cylindrical steel shell 312, and top and bottom assembly 314 and 316 welded to the upper and lower ends of shell 312, respectively, to close and seal same. Shell 312 houses the major components of the compressor, generally including an electric motor 318 having a stator 320 (with conventional windings 322) press fit within shell 312, motor rotor 324 heat shrunk on a crankshaft 328, a compressor body 330 welded to shell 312 at a plurality of circumferentially spaced locations and supporting an orbiting scroll member 340 having a scroll wrap 335 of a standard desired flank profile and a tip surface 333, an upper crank shaft beating 339 of conventional two-piece bearing construction, a non-orbiting axially compliant scroll member 336 having a scroll wrap 337 of a standard desired flank profile meshing with wrap 335 in the usual manner and a tip surface 331, a discharge port 341 in scroll member 336, an Oldham ring 338 disposed between scroll member 340 and body 330 to prevent rotation of scroll member 340, a suction inlet fitting (not shown) soldered or welded to shell 312, a directed suction assembly 342 for directing suction gas to the compressor inlet, and lower bearing support bracket welded at each end to shell 312, and supporting a lower crank shaft bearing in which is journaled the lower end of crankshaft 328. The lower end of the compressor constitutes a sump filled with lubricating oil.

Orbiting scroll member 340 comprises an end plate 302 having generally flat parallel upper and lower surfaces 304 and 306, respectively, the latter slidably engaging a flat circular thrust bearing surface 308 on body 330. Tips 331 of scroll wrap 337 sealingly engage surface 304, and tips 331 of scroll wrap 335 in turn sealingly engage a generally flat and parallel surface 317 on scroll member 336.

Integrally depending from scroll member 340 is a hub 358 having an axial bore 350 therein which has rotatably journaled therein a circular cylindrical unloading drive bushing 352 having an axial bore 354 in which is drivingly disposed an eccentric crank pin 356 integrally formed at the upper end of crankshaft 328. The drive is radially compliant, with crank pin 356 driving bushing 352 via a flat surface on pin 356 which slidably engages a flat bearing insert disposed in the wall of bore 354. Rotation of crankshaft 328 causes bushing 352 to rotate about the crankshaft axis, which in turn causes scroll member 340 to move in a circular orbital path.

Referring to FIGS. 11–15, rotation of scroll member 340 relative to body 330 and scroll member 336 is prevented by an Oldham coupling, comprising Oldham ring 338 which has a pair of downwardly projecting diametrically opposed integral keys 364 and 365 slidably disposed in diametrically opposed radial slots (not shown) formed in scroll member 340, and angularly spaced 90 degrees therefrom, a pair of upwardly projecting diametrically opposed integral keys 368 and 369 slidably disposed in diametrically opposed radial slots 366 and 367 formed in body 330.

Oldham ring 338 is of a unique configuration whereby it permits the use of a maximum size thrust bearing for a given overall machine size (in transverse cross section), or a minimum size machine for a given size thrust bearing. This is accomplished by taking advantage of the fact that the Oldham ring moves in a straight line with respect to the compressor body, and thus configuring the ring with a generally oval or racetrack shape of minimum inside dimension to clear the edge of thrust bearing surface 308. The shape of Oldham ring 338 according to the second embodiment of the present invention, comprises a half circle portion 382 of radius R2 taken from center U and an opposite half circle portion 384 of the same radius R2 taken from center V, with the intermediate wall portion being substantially straight, as at 386 and 388, and an outer circle portion 390 of radius R3 taken from center W. Center points U and V are spaced apart a distance equal to twice the orbital radius of scroll member 340 and are located on lines 396 passing near keys 364 and 365. Radius R2 is equal to the radius of thrust bearing surface 308 plus a predetermined minimum clearance.

Figure 12:
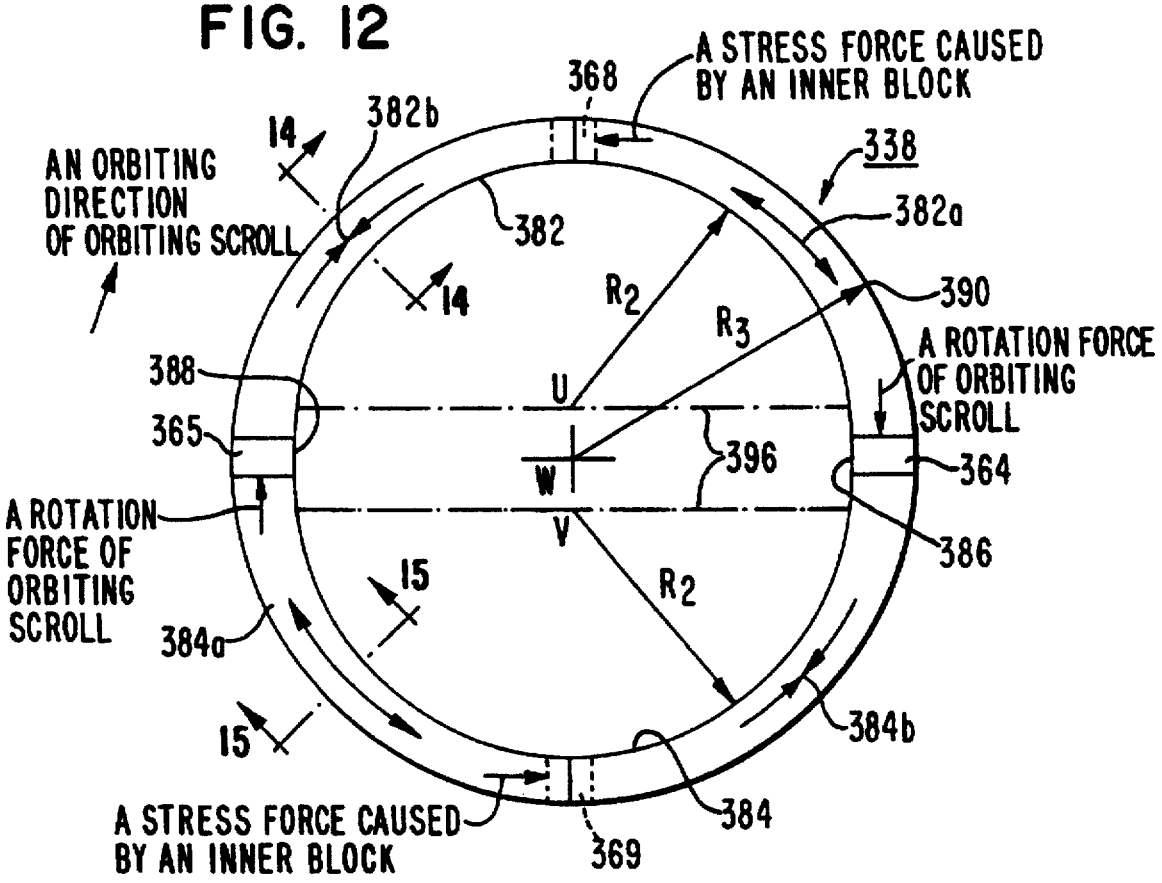
FIG. 12 is a plane view of an Oldham ring in accordance with the second embodiment of the present invention.
Figure 13:
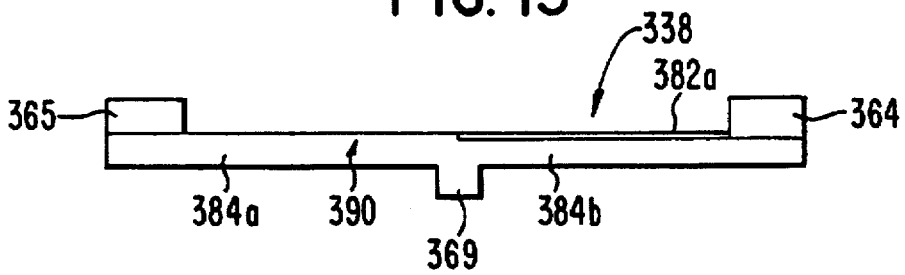
FIG. 13 is a side elevational view of an Oldham ring of FIG. 12.
Figure 14:
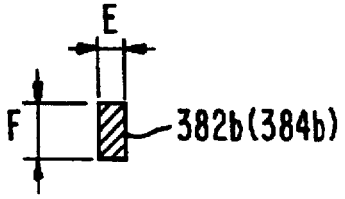
FIG. 14 is a cross sectional view of an Oldham ring taken along line 14—14 of FIG. 12.
Figure 15:
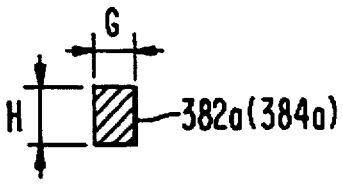
FIG. 15 is a cross sectional view of an Oldham ring taken along line 15—15 of FIG. 12.

When orbiting scroll member 340 orbits clockwise as shown by the arrow in FIG. 12, rotation of orbiting scroll member 340 is prevented by each of keys 364 and 365 being respectively subjected to rotation force from orbiting scroll member 340. Further, rotation is also prevented by each of keys 368 and 369 being respectively subjected to a stress force caused by body 330. Thereby, a tensile force occurs and acts on ring portion **382*a* formed between keys 364 and 368, and acts on ring portion 384*a* formed between keys 365 and 369. On the other hand, a compression stress occurs and acts on ring portion 384*a* formed between keys 364 and 369, and acts on ring portion 382*b* formed between keys 365 and 368**.

Ring portions **382*b* and 384*b* have varying cross sectional areas which are symmetric about center W. Ring portions 382*a* and 384*a* also have varying cross sectional areas which are symmetric about center W. Nevertheless, the cross sectional area of at least one of ring portion 382*b* and 384*b* is smaller than that of ring portions 382*a* and 384*a*. The cross sectional areas of ring portion 382*b* and 384*b* is determined by multiplying width E by thickness F. The cross sectional area of ring portions 382*a* and 384*a* is determined by multiplying width G by thickness H. Thus, the cross sectional area relationship between ring portions 382*a*/384*a* and 382*b*/384*b*** is expressed by the following inequality.

$$E \times F < G \times H$$

In one embodiment, the thickness, F of cross sectional area of ring portions **382*b* (384*b*) is smaller than the thickness, H of cross sectional area of ring portion 382*a* (384*a*). In another embodiment, either the width or the thickness of cross sectional area of ring portions 382*b* (384*b*) is smaller than the width or the thickness of cross sectional area of ring portions 382*a* (384*a***).

In operation, Oldham ring 338 prevents rotation of orbiting scroll member 340 as follows. Orbiting scroll member 340 straightly slides along keys 364 and 365 of Oldham ring 338 so that grooves **340*a* and 340*b* slidably engage in keys 364 and 365. Further, keys 368 and 369 reciprocately slide in radial slots 366 and 367 of body 330. Thus, orbiting scroll member 340 orbits fixed scroll member 363** through these two movements without rotation.

Oldham ring 338 is made of a material, such as sintering metal or aluminum die cast, having an ability to withstand compression stress greater than an ability to withstand tensile stress.

Except for the shape of Oldham ring 338, the Oldham coupling of the second embodiment functions in the same manner as the Oldham coupling of the first embodiment. Further, the Oldham coupling of the second embodiment has substantially the same advantages as the Oldham coupling of the first embodiment. That is, by decreasing the cross sectional area of the portions of the ring which are subject to compression stress, the weight of the ring can be reduced thereby leading to a commensurate reduction in noise and vibration of the compressor during high speed operation.

This invention has been described in connection with the preferred embodiments, but these embodiments are merely for example only, and the invention should not be construed as limited thereto. It should be apparent to those skilled in the art that other variations or modifications can be made within the scope defined by the appended claims. Thus, while the preferred embodiments illustrate the invention as used in any scroll type fluid displacement apparatus, the invention can be used in any other high pressure type fluid displacement apparatus.

What is claimed is:

1. A scroll type fluid displacement apparatus comprising:

a housing having an inlet port and outlet port and a pair of grooves disposed on an inner surface of the housing;

a fixed scroll fixedly disposed within said housing and having a circular end plate from which a first spiral element extends into an interior of said housing;

an orbiting scroll having a circular end plate from which a second spiral element extends, said first and second spiral elements interfitting at an angular and radial offset to form a plurality of line contacts defining at least one pair of fluid pockets within the interior of said housing, said orbiting scroll having a pair of grooves formed on said circular end plate;

a driving mechanism operatively connected to said orbiting scroll to effect orbital motion of said orbiting scroll;

an Oldham coupling disposed between said orbiting scroll and said housing for preventing rotation of said orbiting scroll during orbital motion thereby enabling said orbital motion to change a volume of said at least one pair of fluid pockets, said Oldham coupling comprising:

a ring having at least one first quarter circle portion subject to a compressive stress and at least one second quarter circle portion subject to a tensile stress;

a pair of first engaging means formed on said ring so as to be diametrically opposed to each other, said first pair of engaging means engaging said pair of grooves of said circular end plate of said orbiting scroll;

a pair of second engaging means formed on said ring so as to be diametrically opposed to each other and angularly spaced from said pair of first engaging means by 90 degrees, said pair of second engaging means engaging said pair of grooves disposed on an inner surface of said housing; and, said at least one first quarter circle portion having a cross sectional area at each point within the first quarter circle portion which is smaller than a cross sectional area of said at least one second quarter circle portion.

2. The fluid displacement apparatus of claim 1, wherein said pair of first engaging means and said pair of second engaging means extend radially from an outer peripheral surface of said ring.

3. The fluid displacement apparatus of claim 1, wherein said pair of first engaging means project downwardly from a first surface of said ring, and said pair of second engaging means project upwardly from a second surface of said ring.

4. The fluid displacement apparatus of claim 1, wherein either a width or a thickness of said at least one ring portion subjected to a compressive stress is smaller than a width or a thickness of said at least one ring portion subjected to a tensile stress.

5. The fluid displacement apparatus of claim 1, wherein said ring of said Oldham coupling comprises an oval shape inner periphery of minimum inner dimension sufficient to clear a peripheral edge of a boss of said orbiting scroll.

6. The fluid displacement apparatus of claim 1, wherein said ring of said Oldham coupling comprises an oval shape inner periphery of minimum inner dimension sufficient to clear a peripheral edge of a bearing disposed between said housing and said orbiting scroll.

7. The fluid displacement apparatus of claim 2, wherein said pair of first engaging means is axially offset from a surface of said ring.

8. A scroll type fluid displacement apparatus comprising:

a housing having an inlet port and an outlet port and a pair of grooves disposed on an inner surface of said housing;

a fixed scroll fixedly disposed within said housing and having a circular end plate from which a first spiral element extends into an interior of said housing;

an orbiting scroll having a circular end plate from which a second spiral element extends, said first and second spiral elements interfitting at an angular and radial offset to form a plurality of line contacts defining at least one pair of fluid pockets within the interior of said housing, said orbiting scroll having a pair of grooves formed on said circular end plate;

a driving mechanism operatively connected to said orbiting scroll to effect orbital motion of said orbiting scroll; and an Oldham coupling disposed between said orbiting scroll and said housing for preventing rotation of said orbiting scroll during orbital motion thereby enabling said orbital motion to change a volume of the at least one pair of fluid pockets, said Oldham coupling comprising:

a ring comprising four quarter circle portions and a pair of intermediate straight wall portions, said four quarter circle portions comprising a first pair of quarter circle portions symmetric to each other about a center point of said ring, said first pair of quarter circle portions being subjected to a compressive stress during operation of said displacement apparatus and a second pair of quarter circle portions symmetric to each other about the center of said ring, said second pair of quarter circle portions being subjected to a tensile stress during operation of said displacement apparatus;

a pair of first engaging means formed on said ring so as to be diametrically opposed to each other, said pair of first engaging means engaging said pair of grooves formed on said circular end plate of said orbiting scroll;

a pair of second engaging means formed on said ring so as to be diametrically opposed to each other and angularly spaced from said pair of first engaging means by 90 degrees, said pair of second engaging means engaging said pair of grooves disposed on an inner surface of said housing; and, a cross sectional area at each point within at least one of said first pair of quarter circle portions being smaller than a cross sectional area of at least one of said second pair of quarter circle portions.

9. The fluid displacement apparatus of claim 8, wherein said pair of first engaging means and said pair of second engaging means extend radially from an outer peripheral surface of said ring.

10. The fluid displacement apparatus of claim 8, wherein said pair of first engaging means projects downwardly from a first surface of said ring, and said pair of second engaging means projects upwardly from a second surface of said ring.

11. The fluid displacement apparatus of claim 8, wherein either a width or a thickness of one of said first pair of quarter circle portions is smaller than a width or a thickness of one of said second pair of quarter circle portions.

12. The fluid displacement apparatus of claim 8, wherein said ring of said Oldham coupling comprises an oval shape inner periphery of minimum inner dimension sufficient to clear a peripheral edge of a boss of said orbiting scroll.

13. The fluid displacement apparatus of claim 8, wherein said ring of said Oldham coupling comprises an oval shape inner periphery of minimum inner dimension sufficient to clear a peripheral edge of a bearing disposed between said housing and said orbiting scroll.

14. The fluid displacement apparatus of claim 9, wherein said pair of first engaging means is axially offset from a surface of said ring.

15. A scroll type fluid displacement apparatus comprising:

a housing having an inlet port and outlet port and a pair of grooves disposed on an inner surface of the housing;

a fixed scroll fixedly disposed within said housing and having a circular end plate from which a first spiral element extends into an interior of said housing;

an orbiting scroll having a circular end plate from which a second spiral element extends, said first and second spiral elements interfitting at an angular and radial offset to form a plurality of line contacts defining at least one pair of fluid pockets within the interior of said housing, said orbiting scroll having a pair of grooves formed on said circular end plate;

a driving mechanism operatively connected to said orbiting scroll to effect orbital motion of said orbiting scroll;

an Oldham coupling disposed between said orbiting scroll and said housing for preventing rotation of said orbiting scroll during orbital motion thereby enabling said orbital motion to change a volume of said at least one pair of fluid pockets, said Oldham coupling comprising:

a ring having at least one first quarter circle portion subject to a compressive stress and at least one second quarter circle portion subject to a tensile stress;

a pair of first engaging means formed on said ring so as to be diametrically opposed to each other, said first pair of engaging means engaging said pair of grooves of said circular end plate of said orbiting scroll;

a pair of second engaging means formed on said ring so as to be diametrically opposed to each other and angularly spaced from said pair of first engaging means by 90 degrees, said pair of second engaging means engaging said pair of grooves disposed on an inner surface of said housing; and, one of said engaging means being located between one of said first quarter circle portions and one of said second quarter circle portions, said one of said first quarter circle portions having cross sectional areas at points angularly spaced from said one engaging means which are smaller than cross sectional areas at points within said one of said second quarter circle portion which are angularly spaced a corresponding distance from said one engaging means.

* * * * *